US008186411B2

(12) United States Patent
Lin

(10) Patent No.: US 8,186,411 B2
(45) Date of Patent: May 29, 2012

(54) WINDOW BLIND ASSEMBLY

(76) Inventor: Shih-Ming Lin, Chiayi Hsien (TW)

( * ) Notice: Subject to any disclaimer, the term of this patent is extended or adjusted under 35 U.S.C. 154(b) by 236 days.

(21) Appl. No.: 12/652,250

(22) Filed: Jan. 5, 2010

(65) Prior Publication Data

US 2011/0162806 A1 Jul. 7, 2011

(51) Int. Cl.

| | |
|---|---|
| ***A47H 5/00*** | (2006.01) |
| ***E06B 3/48*** | (2006.01) |
| ***E06B 3/94*** | (2006.01) |
| ***E06B 9/06*** | (2006.01) |
| ***E06B 3/32*** | (2006.01) |
| ***E06B 9/08*** | (2006.01) |

(52) U.S. Cl. ..... 160/84.01; 160/89; 160/108

(58) Field of Classification Search ..... 160/108, 160/109, 110, 111, 113, 120, 121.1, 349.2, 160/84.01, 84.03, 84.04, 89

See application file for complete search history.

(56) References Cited

U.S. PATENT DOCUMENTS

| | | | | |
|---|---|---|---|---|
| 6,502,619 | B1 * | 1/2003 | Kraeutler | 160/84.01 |
| 2010/0269984 | A1 * | 10/2010 | Hanley et al. | 160/84.04 |
| 2010/0269985 | A1 * | 10/2010 | Hanley et al. | 160/84.04 |
| 2010/0294438 | A1 * | 11/2010 | Kirby et al. | 160/84.04 |
| 2011/0067820 | A1 * | 3/2011 | Hsu et al. | 160/84.03 |
| 2011/0108206 | A1 * | 5/2011 | Hsu et al. | 160/84.04 |
| 2011/0146918 | A1 * | 6/2011 | Vestal | 160/84.06 |

* cited by examiner

*Primary Examiner* — Katherine W Mitchell
*Assistant Examiner* — Jeremy Ramsey

(57) ABSTRACT

A window blind assembly includes a roller blind unit, a curtain member unit, and a clamping unit. The roller blind unit includes a roller rod that extends horizontally and that is rotatably mounted at or in proximity to an upper edge portion of the window, and a roller blind cloth a top edge of which is connected to the roller rod and which is able to be wound around and extended from the roller rod. The curtain member unit includes a folding curtain cloth a top edge of which is mounted at or around the upper edge of the window. The clamping unit includes a connecting clamp that extends horizontally, and has a first clamping portion that clamps onto the folding curtain cloth and a second clamping portion that clamps onto the roller blind cloth.

11 Claims, 9 Drawing Sheets

WINDOW BLIND ASSEMBLY

CROSS-REFERENCE TO RELATED APPLICATIONS

This application hereby claims foreign priority benefits under 35 U.S.C. 119(*a*)-(*d*) or (*f*), or 365(*b*) of Taiwanese patent application number 098134605, filed Oct. 13, 2009, entitled "WINDOW BLIND ASSEMBLY".

BACKGROUND OF THE INVENTION

1. Field of the Invention

The present invention relates to a window blind assembly, more particularly to a window blind assembly that is aesthetically pleasing, structurally simple, and easily taken apart for cleaning.

2. Description of the Related Art

There are different types of conventional window blinds, including the roller blind and the roman blind. The conventional roller blind has a roller blind cloth and a roller rod mounted to a window. The roller blind cloth is connected to the roller rod, and may be wound around and unwound from the roller rod by rotating the roller rod, thereby either covering or uncovering the window.

The roman blind has a curtain cloth mounted to an inner side of a window, and one side of the curtain cloth is provided with some guide rings. Some cords extend through the guide rings, and are then connected to a bottom portion of the curtain cloth. Manipulation of the cords results in folding and unfolding of the curtain cloth.

However, the conventional roller blind has an unsophisticated appearance. The conventional roman blind, on the other hand, is not easily taken apart for cleaning. There is a need for a new curtain structure that deals with these issues.

SUMMARY OF THE INVENTION

Therefore, the object of the present invention is to provide a window blind assembly, which combines aspects of a roller blind and a roman blind, has a structure that is simple, and is low in cost.

Accordingly, a window blind assembly of the present invention is adapted for being mounted to a window. The window blind assembly comprises a roller blind unit, a curtain member unit, and a clamping unit.

The roller blind unit includes a roller rod that extends horizontally and that is rotatably mounted at or in proximity to an upper edge portion of the window, and a roller blind cloth a top edge of which is connected to the roller rod and which is able to be wound around and extended from the roller rod.

The curtain member unit includes a folding curtain cloth a top edge of which is mounted at or around the upper edge of the window.

The clamping unit includes a connecting clamp that extends horizontally, and has a first clamping portion that clamps onto the folding curtain cloth and a second clamping portion that clamps onto the roller blind cloth.

When the roller blind unit is manipulated such that the roller blind cloth is wound around the roller rod, a section of the folding curtain cloth clamped by the first clamping portion of the connecting clamp is displaced upwardly, such that the folding curtain cloth is folded.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
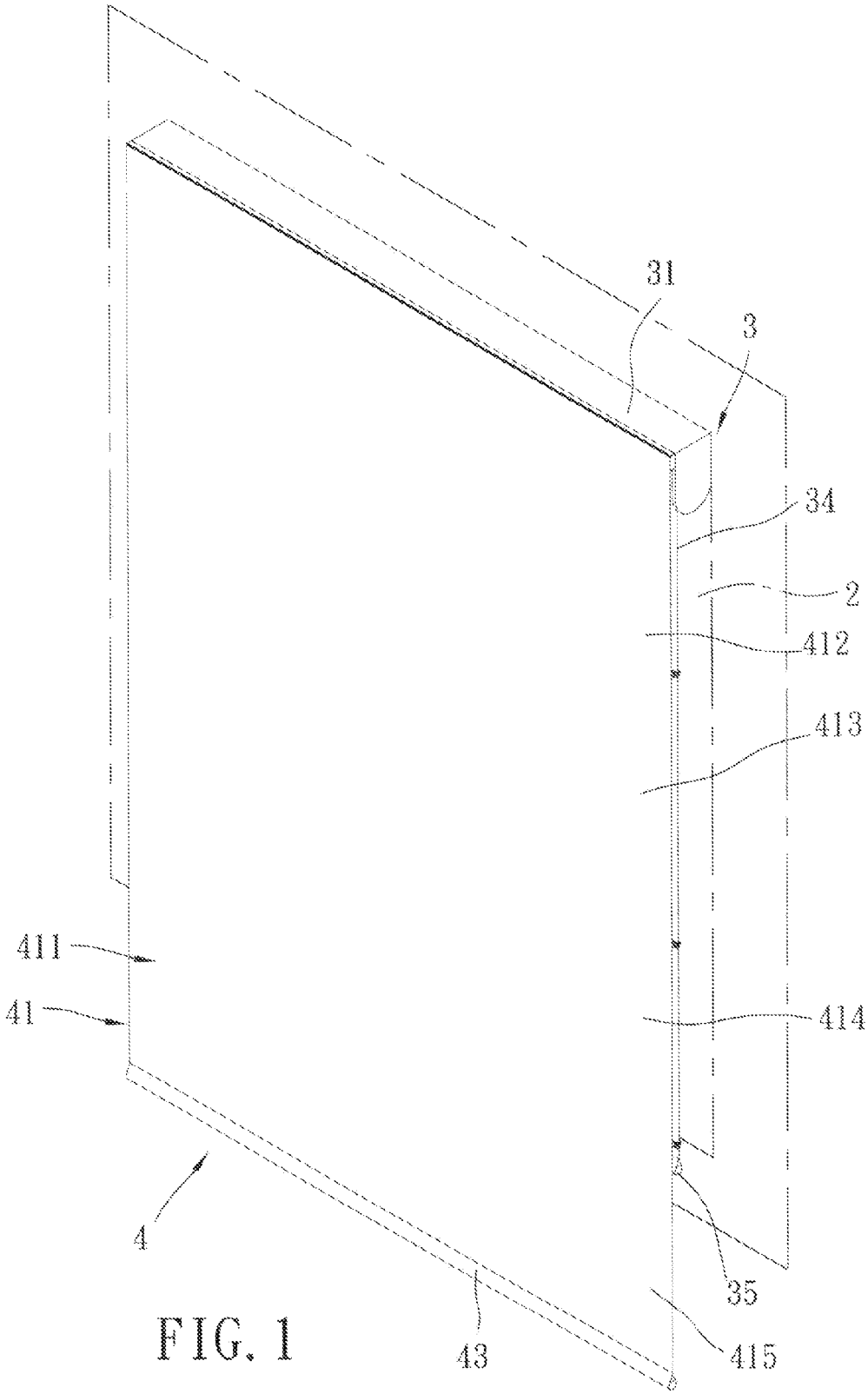
FIG. 1 is a front perspective view of a window blind assembly according to a first preferred embodiment of the present invention.
Figure 2:
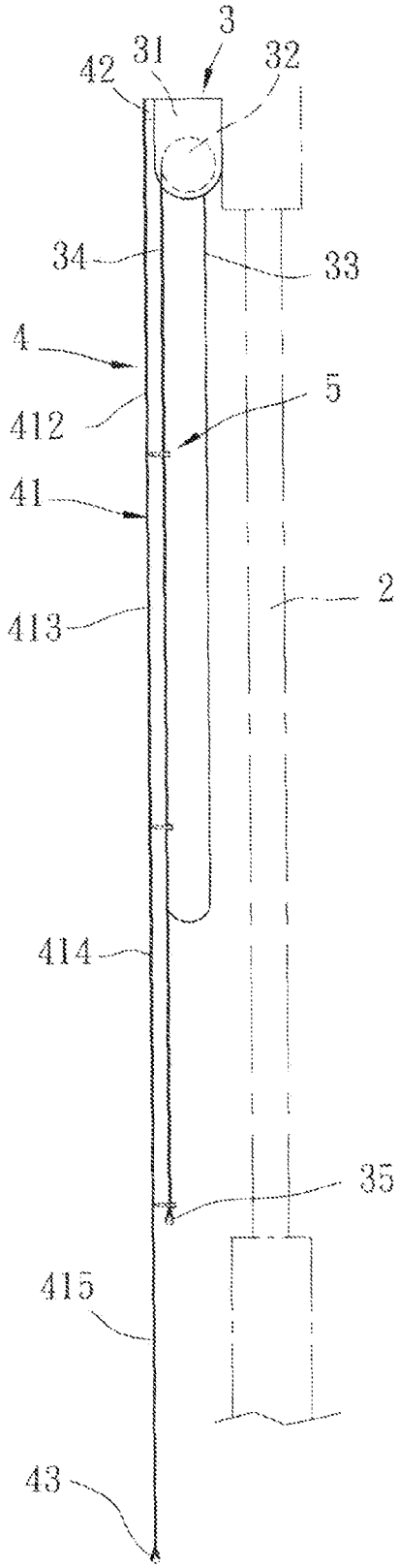
FIG. 2 is a side view of the window blind assembly of the first preferred embodiment.
Figure 3:
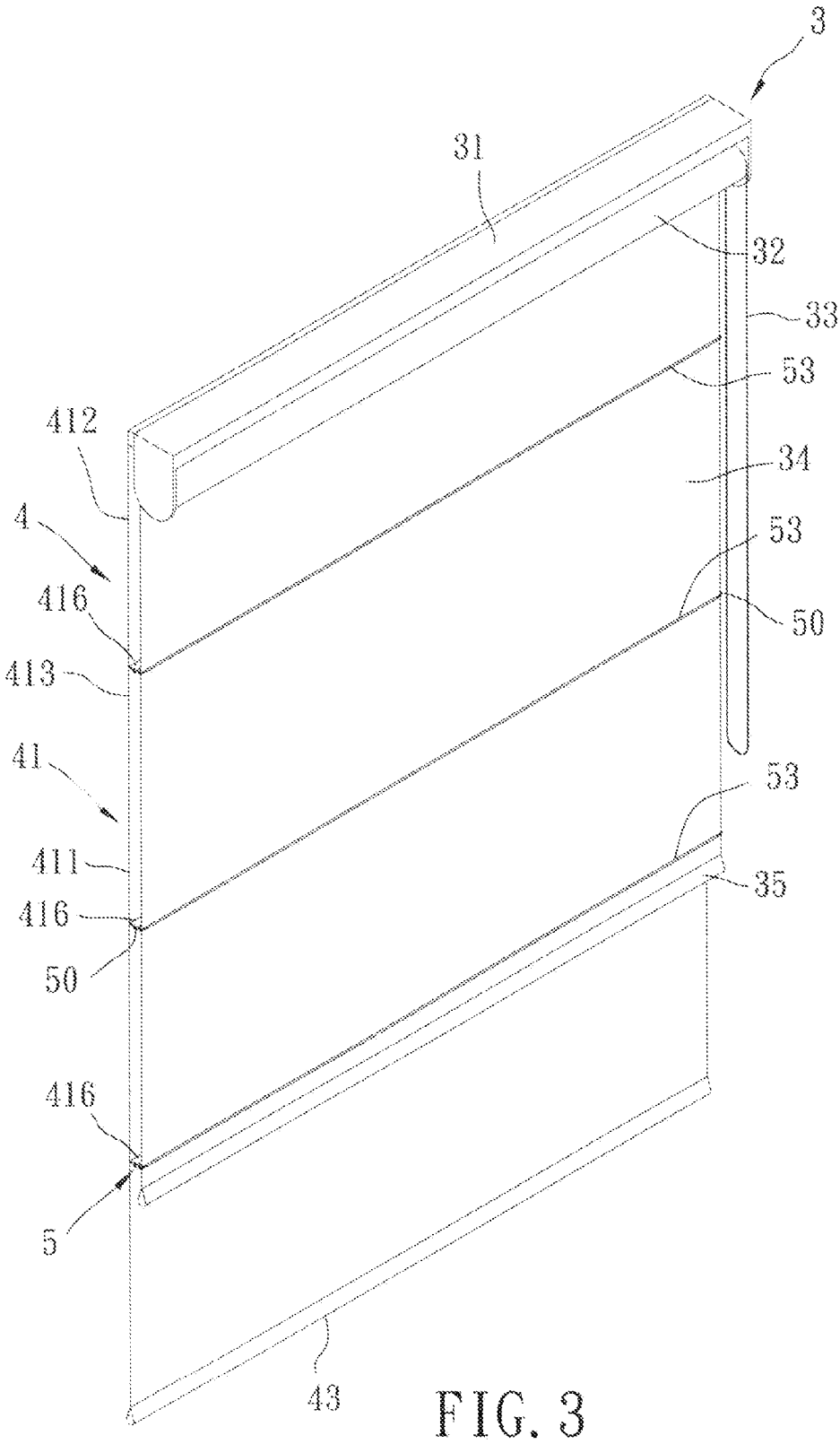
FIG. 3 is a rear perspective view of the window blind assembly of the first preferred embodiment.

Referring to FIGS. 1, 2 and 3, a first preferred embodiment of a window blind assembly of the present invention is adapted for being mounted to a window 2. The window blind assembly includes a roller blind unit 3, a curtain member unit 4, and a clamping unit 5 disposed between and interconnecting the roller blind unit 3 and the curtain member unit 4.

The roller blind unit 3 includes a roller rod 32, a roller blind cloth 34, a horizontal frame 31, a weighting rod 35, and a cord 33.

The roller rod 32 extends horizontally and is rotatably mounted at or in proximity to an upper edge portion of the window 2.

The roller blind cloth 34 has a top edge connected to the roller rod 32, and the roller blind cloth 34 is able to be wound around and extended from the roller rod 32.

The horizontal frame 31 is mounted at least partially surrounding the roller rod 32.

The weighting rod 35 extends horizontally and is connected to a bottom edge of the roller blind cloth 34. The weighting rod 35 pulls down on the roller blind cloth 34 to flatten the same by virtue of its weight.

The cord 33 is coupled to the roller rod 32 for controlling rotation of the same such that the roller blind cloth 34 is wound around or extended from the roller rod 32. As described above, the roller blind unit 3 is manipulated by pulling the cord 33 to drive the roller rod 32 such that the roller blind cloth 34 is wound around the roller rod 32 or extended downwardly. During the winding of the roller blind cloth 34 around the roller rod 32, a section of the curtain member unit 4 clamped by the connecting clamp 50 is displaced upwardly, such that the curtain member unit 4 is folded. This will be described in greater detail below.

The roller rod 32 may be driven by the cord 33 as described above, or can be driven by a motor (not shown), or can be driven through a spring mechanism (not shown). Therefore, the driving method is not limited to the embodiment described herein. The curtain member unit 4 includes a folding curtain cloth 41, a fastening member 42, and a rod 43.

The folding curtain cloth 41 has a top edge mounted at or around the upper edge of the window 2, and the folding curtain cloth 41 is disposed in front of the roller blind cloth 34.

The fastening member 42 interconnects the horizontal frame 31 and the top edge of the folding curtain cloth 41. As an example, the horizontal frame 31 may be made of a fabric material, the fastening member 42 may be a hook fastener, such as that found in a Velcro® fastener, and the fastening member 42 may attach to the fabric material of the horizontal frame 31 through a hook-and-loop engagement with the horizontal frame 31.

The rod 43 horizontally extends and is connected to a bottom edge of the folding curtain cloth 41.

In the preferred embodiment, the folding curtain cloth 41 has a sheltering portion 411 and three sleeving portions 416. Each of the sleeving portions 416 extends horizontally, and is connected to a rear surface of the sheltering portion 411 of the folding curtain cloth 41. The sheltering portion 411 has a first cloth segment 412, a second cloth segment 413, a third cloth segment 414, and a fourth cloth segment 415, which are arranged vertically in this order. The sleeving portions 416 horizontally extend, and are respectively disposed at connecting portions between the first cloth segment 412 and the second cloth segment 413, between the second cloth segment 413 and the third cloth segment 414, and between the third cloth segment 414 and the fourth cloth segment 415.

Figure 4:
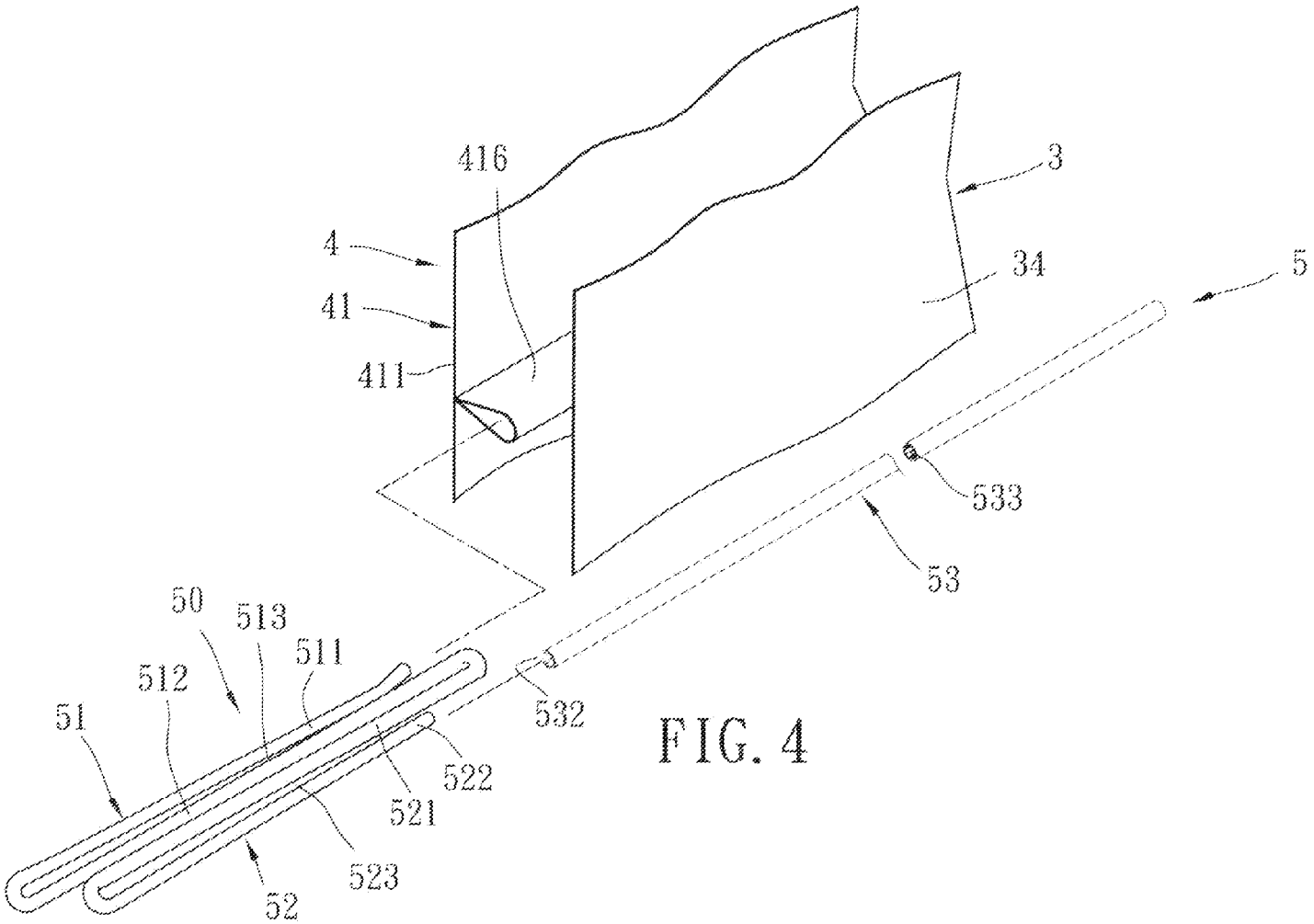
FIG. 4 is a fragmentary exploded perspective view of a connecting clamp, a folding curtain cloth, and a roller blind cloth of the first preferred embodiment.
Figure 5:
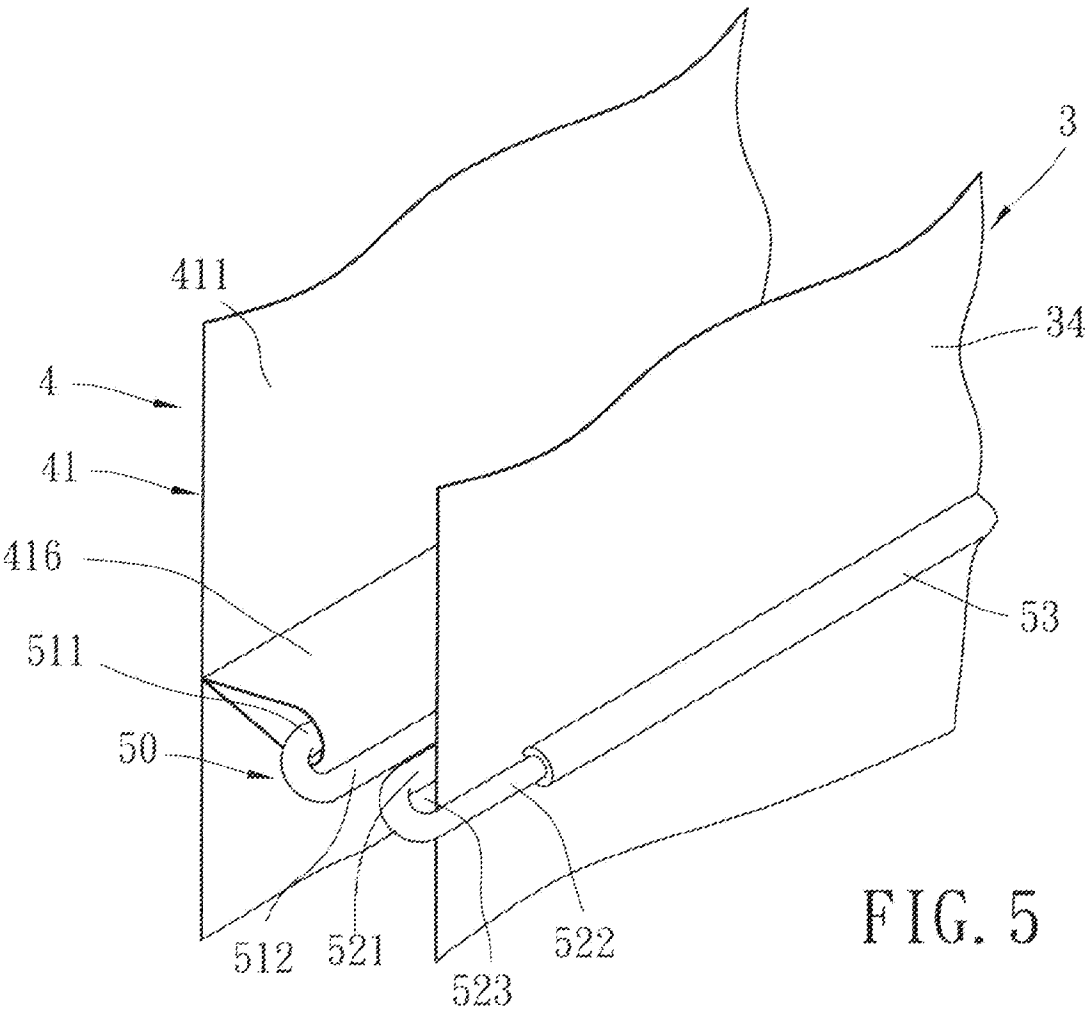
FIG. 5 is a view similar to FIG. 4, but illustrating an assembly of the connecting clamp, the folding curtain cloth, and the roller blind cloth of the first preferred embodiment in an assembled state.

Referring to FIGS. 3, 4 and 5, in the preferred embodiment, the clamping unit 5 includes three connecting clamps 50 and three connecting tubes 53. The connecting clamps 50 extend horizontally and are vertically spaced apart from each other.

In an effort to simplify the discussion to follow immediately below, the structure as it relates only to one of the connecting clamps 50 and one of the connecting tubes 53 will be described.

The connecting clamp 50 has a first clamping portion 51 that clamps onto the folding curtain cloth 41 and a second clamping portion 52 that clamps onto the roller blind cloth 34.

The connecting tube 53 extends horizontally on a rear surface of the roller blind cloth 34, and is connected to a respective one of the second clamping portions 52 of the connecting clamps 50. The first clamping portion 51 of the connecting clamp 50 has a front rod 511 and a rear rod 512 which are disposed adjacent to each other and end portions of which are connected to each other. The front rod 511 and the rear rod 512 of the first clamping portion 51 define a first slot 513 for clamping onto the folding curtain cloth 41. In this embodiment, the front rod 511 of the first clamping portion 51 is inserted into a respective one of the sleeving portions 416, such that the first clamping portion 51 clamps onto the sleeving portion 416.

The second clamping portion 52 has a front rod 521 and a rear rod 522 disposed adjacent to each other and end portions of which are connected to each other. The front rod 521 and the rear rod 522 of the second clamping portion 52 define a second slot 523 for clamping onto the roller blind cloth 34.

In this embodiment, the front rod 521 of the second clamping portion 52 is coupled to the rear rod 512 of the first clamping portion 51. In some embodiments, a metal rod can be bent to form the connecting clamp 50. In other embodiments, the connecting clamp 50 can be formed using plastic material. Hence, the present invention is not limited with respect to the material and fabricating method used for the connecting clamp 50.

The connecting tube 53 is sleeved on the rear rod 522 of the second clamping portion 52 of the connecting clamp 50. End portions of the connecting tube 53 of the clamping unit 5 are formed with slits 532 that extend horizontally and facilitate inserting of the rear rod 522 of the second clamping portion 52 into the connecting tube 53. An inner surface of the connecting tube 53 of the clamping unit 5 is formed with a plurality of lengthwise ribs 533. The ribs 533 are used for enhancing the strength of the connecting tube 53 so as to prevent the same from being bent when in use.

Figure 6:
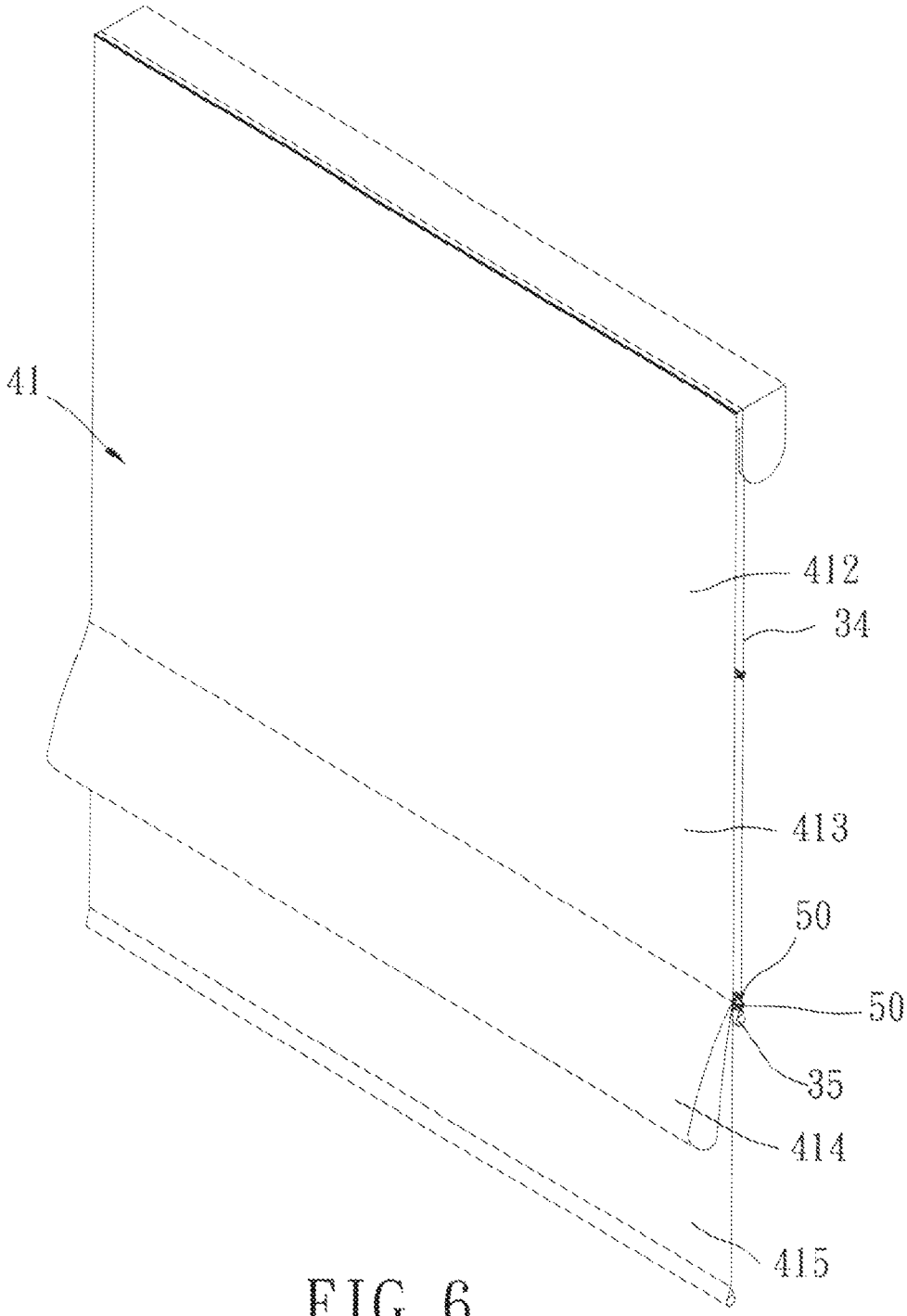
FIG. 6 is view similar to FIG. 1, but illustrating a roller blind unit in a partially wound state and the folding curtain cloth in a partially folded state.

Referring to FIGS. 1, 2, and 3, the roller blind cloth 34 of the roller blind unit 3 and the folding curtain cloth 41 of the curtain member unit 4 are respectively unwound and unfolded downwardly when the window 2 is covered. On the other hand, the roller blind cloth 34 of the roller blind unit 3 is wound upwardly by pulling the cord 33 of the roller blind unit 3 which results in rotation of the roller rod 32. When the roller blind cloth 34 is wound around the roller rod 32, the weighting rod 35 moves upwardly to first push against the lowest connecting clamp 50 and the lowest connecting tube 53, and to subsequently displace the lowest connecting clamp 50 and the lowest connecting tube 53 in an upward direction. As a result, the third cloth segment 414 is folded as shown in FIG. 6. Referring to FIGS. 3 and 6, this process is repeated with the continued winding of the roller blind cloth 34, such that the roller blind cloth 34 is fully wound around the roller rod 32, and the second cloth segment 413 and the first cloth segment 412 are eventually folded upwardly as shown in FIGS. 7 and 8.

Figure 7:
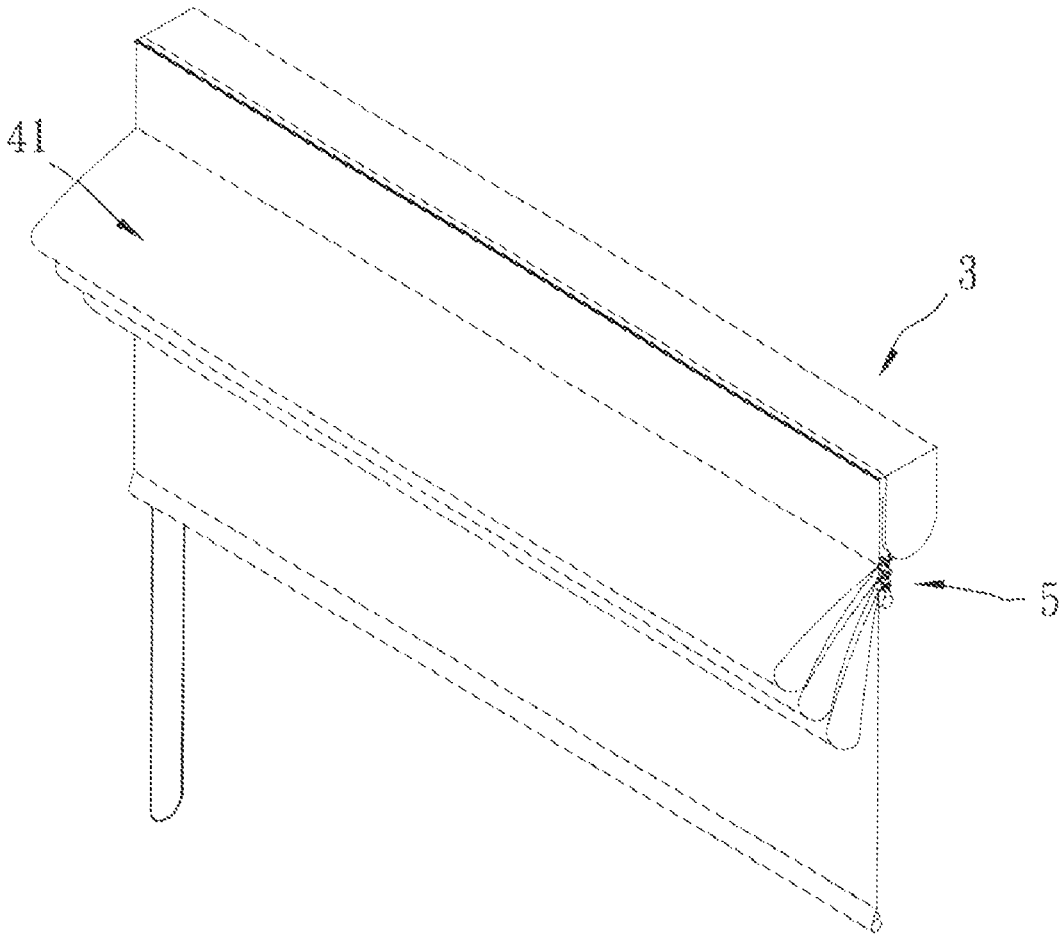
FIG. 7 is view similar to FIG. 6, but illustrating the roller blind unit in a fully wound state and the folding curtain cloth in a fully folded state.
Figure 8:
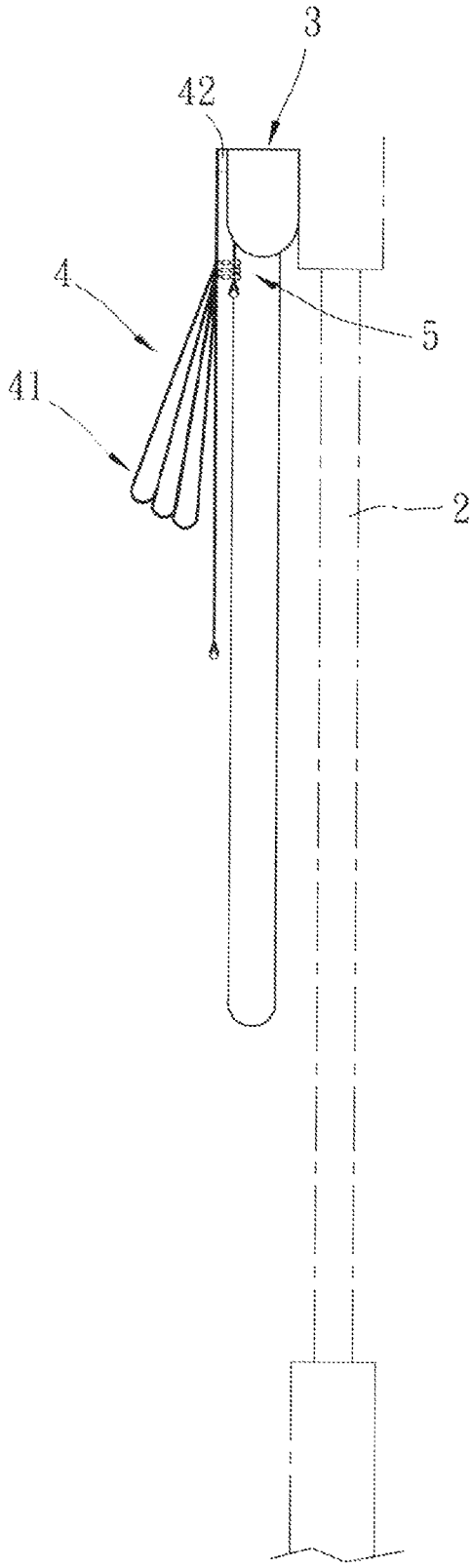
FIG. 8 is a view similar to FIG. 2, but illustrating the roller blind unit in a fully wound state and the folding curtain cloth a fully folded state.

FIGS. 7 and 8 show that the folded curtain member unit 4 has a sophisticated, classic appearance.

In the present invention, the roller blind unit 3 is provided with the folding curtain cloth 41 and the clamping unit 5 is mounted between the curtain member unit 4 and the roller blind unit 3. Hence, the result is a style resembling a roman blind, a structure that allows for mounting that is simple, and an overall design in which the cost thereof is reduced.

Referring to FIGS. 1, 2, and 4, the folding curtain cloth 41 uses the fastening member 42 for attachment to the horizontal frame 31. Accordingly, by simply removing the fastening member 42 and the connecting clamps 50, the folding curtain cloth 41 can be removed for cleaning or for replacement with another folding curtain cloth 41 with a different style. In addition, the slit 532 of the connecting tube 53 of the clamping unit 5 allows for convenient insertion of the rear rod 522 of the connecting clamp 50 into the connecting tube 53.

Figure 9:
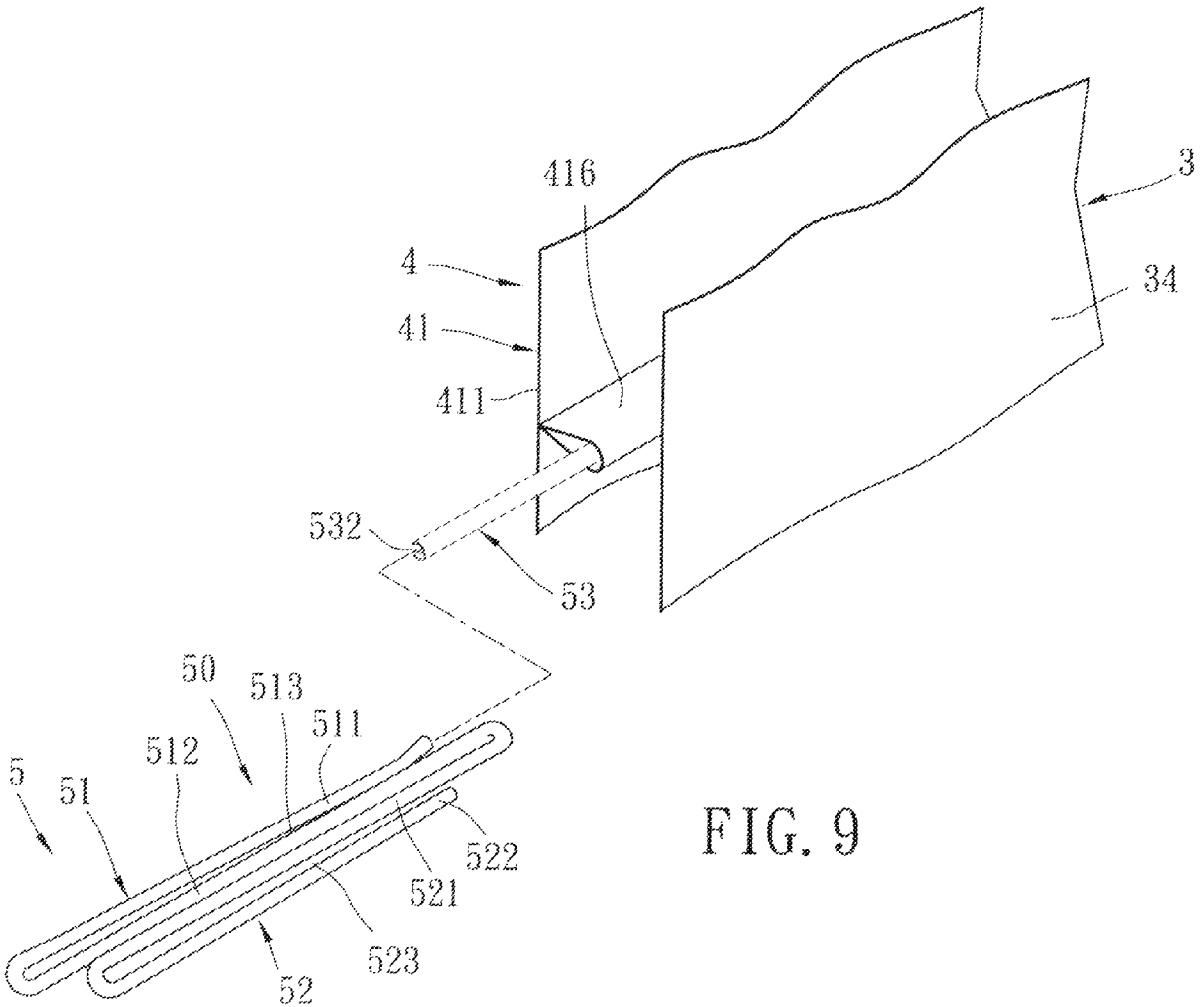
FIG. 9 is a fragmentary exploded perspective view of the connecting clamp, the folding curtain cloth, and the roller blind cloth according to a second preferred embodiment of the present invention.

FIG. 9 illustrates a second preferred embodiment of the window blind assembly according to the present invention. The second preferred embodiment differs from the first preferred embodiment in the following aspects.

The connecting tube 53 of each of the connecting clamps 50 extends into a respective one of the sleeving portions 416, and is sleeved on the front rod 511 of the first clamping portion 51 of the corresponding connecting clamp 50. During the process of being folded upwardly, the connecting tube 53 can horizontally support the folding curtain cloth 41.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A window blind assembly adapted for being mounted to a window, said window blind assembly comprising:

a roller blind unit including a roller rod that extends horizontally and that is rotatably mounted at or in proximity to an upper edge portion of the window, and a roller blind cloth a top edge of which is connected to said roller rod and which is able to be wound around and extended from said roller rod;

a curtain member unit including a folding curtain cloth a top edge of which is mounted at or around the upper edge of the window; and a clamping unit including a connecting clamp that extends horizontally, and has a first clamping portion that clamps onto said folding curtain cloth and a second clamping portion that clamps onto said roller blind cloth;

wherein when said roller blind unit is manipulated such that said roller blind cloth is wound around said roller rod, a section of said folding curtain cloth clamped by said first clamping portion of said connecting clamp is displaced upwardly, such that said folding curtain cloth is folded;

wherein said first clamping portion of said connecting clamp has a front rod and a rear rod disposed adjacent to each other and which define a first slot for clamping onto said folding curtain cloth; and wherein said second clamping portion has a front rod and a rear rod disposed adjacent to each other and which define a second slot for clamping onto said roller blind cloth, said front rod of said second clamping portion being coupled to said rear rod of said first clamping portion.

2. The window blind assembly as claimed in claim 1, wherein said roller blind unit further includes a horizontal frame that is mounted at least partially surrounding said roller rod, and said curtain member unit further includes a fastening member that interconnects said horizontal frame and said top edge of said folding curtain cloth.

3. The window blind assembly as claimed in claim 1, wherein said curtain member unit further includes a rod that horizontally extends and is connected to a bottom edge of said folding curtain cloth.

4. The window blind assembly as claimed in claim 1 wherein said clamping unit further includes a connecting tube which extends horizontally on a rear surface of said roller blind cloth, said connecting tube being sleeved on said rear rod of said second clamping portion of said connecting clamp.

5. The window blind assembly as claimed in claim 1, wherein said curtain member unit further includes a sleeving portion that extends horizontally, and is connected to a rear surface of said folding curtain cloth, said front rod of said first clamping portion of said connecting clamp being inserted into said sleeving portion.

6. The window blind assembly as claimed in claim 4, wherein end portions of said connecting tube of said clamping unit are formed with slits that extend horizontally and facilitate inserting of said rear rod of said second clamping portion into said connecting tube.

7. The window blind assembly as claimed in claim 4, wherein an inner surface of said connecting tube of said clamping unit is formed with a lengthwise rib.

8. The window blind assembly as claimed in claim 5, wherein said clamping unit further includes a connecting tube which extends into said sleeving portion, said connecting tube being sleeved on said front rod of said first clamping portion of said connecting clamp.

9. The window blind assembly as claimed in claim 1, wherein said clamping unit further includes a connecting tube which extends horizontally on a rear surface of said roller blind cloth, said connecting tube being connected to said second clamping portion of said connecting clamp.

10. The window blind assembly as claimed in claim 1, wherein said roller blind unit further includes a weighting rod that extends horizontally and that is connected to a bottom edge of said roller blind cloth.

11. The window blind assembly as claimed in claim 1, wherein said roller blind unit further includes a cord coupled to said roller rod for controlling rotation of the same such that said roller blind cloth is wound around or extended from said roller rod.

* * * * *